US006058539A

United States Patent [19]

Mitford-Taylor

[11] Patent Number: 6,058,539

[45] Date of Patent: May 9, 2000

[54] CONVENIENT SCRIBE GAUGE

[76] Inventor: Geoff Mitford-Taylor, 6102 Iroquois, Westminister, Calif. 92683

[21] Appl. No.: 09/183,746

[22] Filed: Oct. 30, 1998

[51] Int. Cl.[7] ..... B25F 1/00

[52] U.S. Cl. ..... 7/164; 30/164.9

[58] Field of Search ..... 30/169, 286, 289, 30/294, 164.9; 7/164

[56] References Cited

U.S. PATENT DOCUMENTS

| | | | |
|---|---|---|---|
| 1,005,637 | 10/1911 | Friebertshauser | 30/164.9 X |
| 3,120,055 | 2/1964 | Baber | 30/164.9 |
| 3,790,052 | 2/1974 | Toll | 30/164.9 X |
| 4,001,903 | 1/1977 | Hay | 7/164 |
| 4,030,195 | 6/1977 | Insolio | 30/164.9 |
| 4,062,117 | 12/1977 | Coleman | 30/294 X |
| 5,127,162 | 7/1992 | Mansfield | 30/294 |
| 5,561,905 | 10/1996 | Sherman | 30/294 X |
| 5,815,930 | 10/1998 | Kojima | 30/294 |

*Primary Examiner*—James G. Smith
*Attorney, Agent, or Firm*—Curtis L. Harrington

[57] ABSTRACT

A quick-availability scribe utilizes a body having a generally rectangular center format, each corner of the rectangular format extending to a curved space along the ends of the body to define a number of curved slots. Each curved slot has a first side perpendicular to an adjacent side edge, an inward curving middle extent, and a second side terminating at an acute angle to form an acute angled edge extending across the thickness of the material. Adjacent slots at one end of the body may share an outward curved transition extending between their acute angled termination edges of their second sides, but any shape transition may be used. Up to four slots can be accommodated while keeping an overall generally rectangular or square format. It is preferable to arrange adjacent slots at the end of a generally rectangular body to skip the next most adjacent scribing magnitude in order to avoid invading too much of the material forming the transition extending between the acute angled termination edges.

9 Claims, 2 Drawing Sheets

CONVENIENT SCRIBE GAUGE

FIELD OF THE INVENTION

The present invention relates to the field of hand tools and particularly to a handy, pocket sized tool for scribing standard width lines in metal and for measuring distances.

BACKGROUND OF THE INVENTION

Sheet metal workers, especially those who prepare custom sheet metal pieces, continually measure, scribe and cut sheet metal throughout the work process. Since much work in sheet metal proceeds using several predominant magnitudes of measurement, the worker finds that the same size measurements need to be made over and over in the course of the work day. Adjustable distance scribes are known, but require the worker to adjust and re-adjust a large scribe device. If the adjustment on an adjustable scribe is not exact an erroneous line will be marked, an erroneous cut will be made; and where the error cannot be corrected, the entire piece will be destined for the scrap pile.

As such, the standard magnitude of measurements occur so often that it is wasteful of time to have sheet metal workers continually re-adjust a variable scribe, especially to produce scribed marks for standard magnitudes.

Other disadvantages of adjustable scribes include accommodation and carriage. A special holster or tool belt pocket must be provided to carry a conventional adjustable scribe. As such, a need for a scribe, especially a scribe needed for scribing standard magnitude dimensions, is ease of transportability. Special compartments, pockets and holsters should not be necessary. Space is also a consideration. The needed scribe should also occupy as little space as possible.

Another need for a portable scribe is a relatively significant number of dimensions. A single scribe should have the ability to mark out several standard sizes. Manual manipulability is also important. The needed scribe should be easy to handle, easy on the hands, and quickly producible from and returnable to a handy storage space.

SUMMARY OF THE INVENTION

A quick-availability scribe utilizes a body having a generally rectangular center format, each corner of the rectangular format extending to a curved space along the ends of the body to define a number of curved slots. Each curved slot has a first side perpendicular to an adjacent side edge, an inward curving mi(idle extent, and a second side terminating at an acute angle to form an acute angled edge extending across the thickness of the material. Adjacent slots at one end of the body may share an outward curved transition extending between their acute angled termination edges of their second sides, but any shape transition may be used. Up to four slots can be accommodated while keeping an overall generally rectangular or square format. It is preferable to arrange adjacent slots at the end of a generally rectangular body to skip the next most adjacent scribing magnitude in order to avoid invading too much of the material forming the transition extending between the acute angled termination edges (which will be seen as an edge in FIG. 3) of the second sides of the inward curving curved slots. For a scribe having dimensions in the English system, corner scribing dimensions may include ¼, ½, ¾, and one inch scribing dimensions. Thus, one end of the scribe would include ¼, and ¾ inch dimensions, while the other end would include ½ inch and one inch dimensions. Further, it is preferable for the two smaller dimension inwardly curving slots to lie along the same elongate edge to provide one maximally long side along which to place an optional scale. For a scribe having dimensions in the metric system, several sets may be preferable. Corner scribing dimensions for a scribe may include dimensions of 2, 3, 4, & 5 millimeters. Another scribe may have dimensions of 6, 8, 12, & 16 millimeters, while another may have dimensions of 10, 15, 20, and 25 millimeters.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
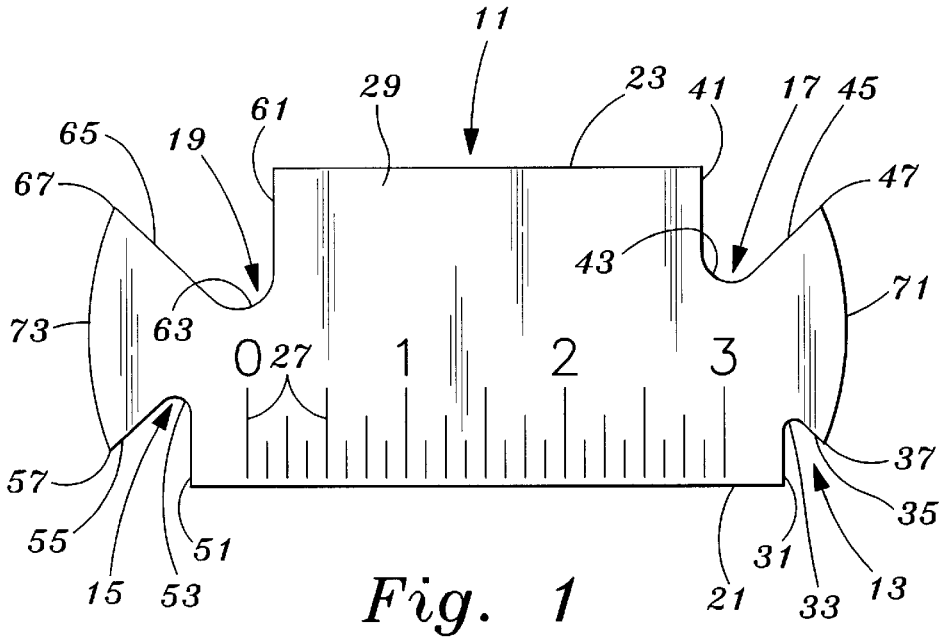
FIG. 1 is a front plan view of the scribe of the invention and illustrating four inwardly curved slots formed on a generally rectangular body and having a measuring scale impressed upon one side of the scribe and along the longest edge.

The description and operation of the invention will be best initiated with reference to FIG. 1 which is a front plan view of a scribe 11 of the invention and illustrating four inwardly curved slots, numbered from smallest to largest as slot 13, slot 15, slot 17 and slot 19. Scribe 11 has two elongate edges, an edge 21 between slots 13 and 15, and an edge 23 between slots 17 and 19. Since edge 21 is located between slots 13 and 15, it is significantly longer than edge 23. Selecting the two smallest slots 13 and 15 to lie at opposite ends of the edge 21 will result in edge 21 being the longer edge.

Note also that the slots 13, 15, 17, and 19 are arranged so that at each end of the scribe 1 1, between the adjacent ends of the edges 21 and 23, that a pair of slots 13, 15, 17, and 19 will be found which are not adjacent in terms of magnitude of size. Where the slots 13, 15, 17, and 19 represent a sequential increase in size, the end of the scribe 11 will contain non adjacent sized slots. Here, one end of the scribe 11 contains the smallest inwardly curving slot 13 and the second from the largest inwardly curving slot 17. Similarly, the other end of the scribe 11 contains the largest inwardly curving slot 19 and the second from the smallest inwardly curving slot 15.

Scribe 11, as seen in FIG. 1 has a scale 27 imprinted or impressed on a side 29. The arrangement of the scale adjacent the edge 21, with edge 21 having the two smallest slots 13 and 15 at the ends thereof, will provide the longer measuring length edge 21.

Slot 13 has a first side 31 perpendicular to its adjacent side edge 21, an inward curving middle extent 33, and a second side 35 terminating at an acute angle termination 37 which is an edge extending across the thickness of the material which is a sufficiently sharp area to form a scribing edge or point. Likewise, slot 17 has a first side 41 perpendicular to its adjacent side edge 23, an inward curving middle extent 43, and a second side 45 terminating at an acute angle termination 47 which is a sufficiently sharp area to form a scribing edge or point.

At the other end of the scribe 11, slot 15 has a first side 51 perpendicular to its adjacent side edge 21, an inward curving middle extent 53, and a second side 55 terminating at an acute angle termination 57 which is a sufficiently sharp area to form a scribing edge or point. Likewise, slot 19 has a first side 61 perpendicular to its adjacent side edge 63, an inward curving middle extent 63, and a second side 65 terminating at an acute angle termination 67 which is a sufficiently sharp area to form a scribing edge or point. Acute angle terminations 67, 57, 47, and 37 are actually very short edges which extend over the width of the scribe 11 and each provides a pair of corner points which provide a sharp scribed line when the scribe 11 is dragged or pulled across the edge of a metal sheet. For example, acute angle termination 67 meets side 29 at one such corner point closest to the observer of FIG. 1. The scribe 11 of FIG. 1 provides four scribing dimensions, each having two corner points, and also provides a scale 27 for handy reference. Also seen is a first outwardly curved edge 71 extending between acute angle termination 37 and acute angle termination 47, and a second outwardly curved edge 73 extending between acute angle termination 57 and acute angle termination 67.

Figure 2:
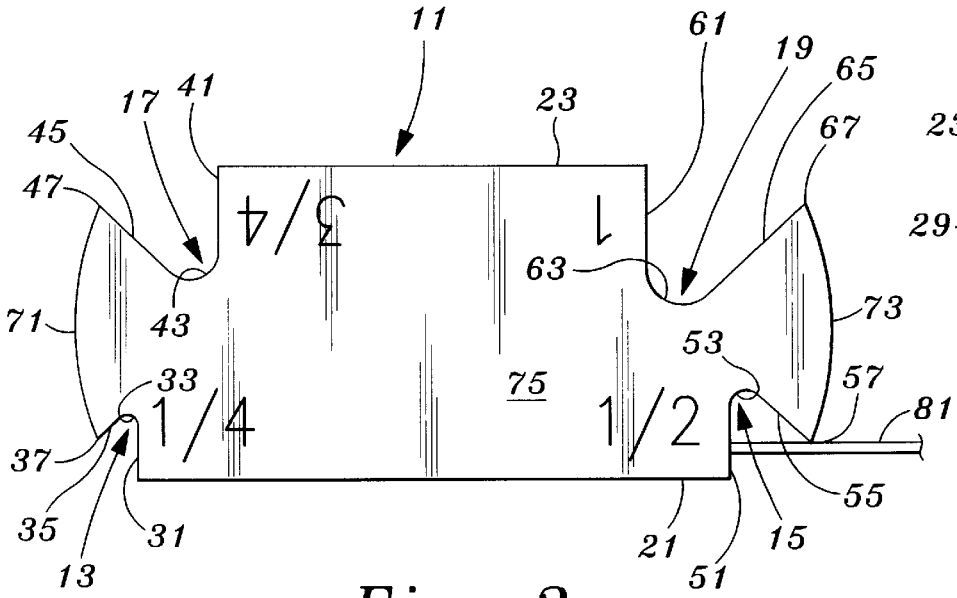
FIG. 2 is a rear plan view of the scribe of the invention and illustrating four inwardly curved slots formed on a generally rectangular body and having a dimension magnitude impressed upon the scribe adjacent the most closely adjacent inwardly curving slot.

Referring to FIG. 2, a rear or reverse side view of the scribe 11 illustrates a second side 75 and which has the scribe depth printed near each of the four inwardly curved slots 13, 15, 17, and 19, as ¼, ½, ¾, and 1, respectively, and will not be otherwise labeled. A length of metal or otherwise markable material 81 is shown as engaged with acute angle termination 57. The outer edge of the material 81 is engaged against the first side 51 of the inwardly curving slot 15. The first side 51 of the inwardly curving slot 15 acts as a stop, and the spacing of the acute angle termination 57 is, in accord with the labeling of FIG. 2, ½ inch from the first side 51 of the inwardly curving slot 15. The orientation of the scribe 11 other slots 13, 17, and 19 with respect to outer edge of material 81 is similar in that the outer edge of material 81 will engage the first sides 31, 41, or 61 of the other slots 13, 17, and 19.

Figure 3:
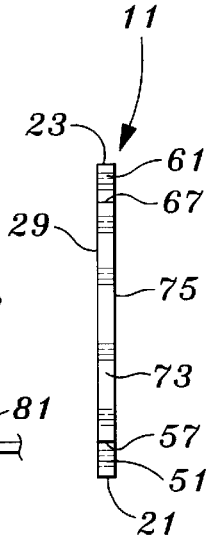
FIG. 3 is an end view of the scribe seen in FIG. 2 and illustrating that the acute angled terminations may be displaced inwardly from the elongate edge of the scribe by about the same amount despite that the magnitude of the line to be scribed is double in magnitude.

Referring to FIG. 3, an end view enables the details and shape of the acute angle terminations 67 and 57 to be seen. FIG. 3 illustrates that the acute angled terminations 67 and 57 may be displaced inwardly from the elongate edges 23 and 21 of the scribe by about the same amount despite that the magnitude of the line to be scribed is double in magnitude.

Figure 4:
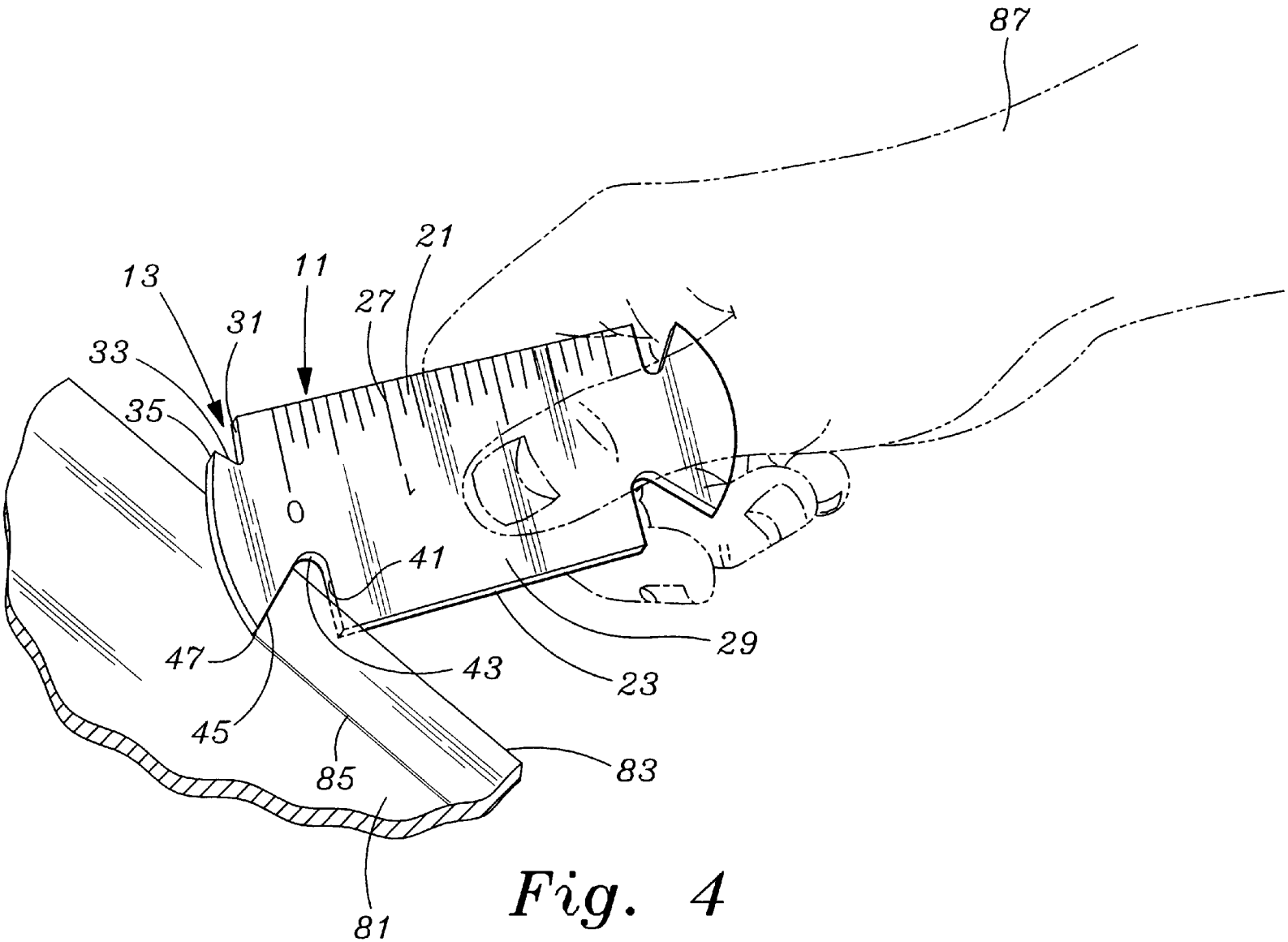
FIG. 4 is an illustration of a perspective view of the scribe of FIGS. 1–3 and illustrating the manual scribing of a line along the edge of a sheet of metal or other planar material.

FIG. 4 is an illustration of a perspective view of the scribe 11 of FIGS. 1–3 and illustrating the manual scribing along an edge 83 of a sheet of metal or other planar material 81 as was seen in FIG. 2. A scribed line 85 is clearly seen. A hand of a user 87 simply holds the scribe 11 so that a first side 31, 41, 51, or 61 is against the outer edge 83 of the planar expanse of material 81 as one of the acute angle terminations 37, 47, 57, or 67 is pressed into contact with the upper 15 surface of the expanse of material 81. A scribed line 85 will be produced which follows the outer edge 83.

While the present invention has been described in terms of a quick use scribe tool, the structure and techniques of the present invention can be synergistically applied to many similar tools where repeated use of finite magnitude spacing is to be used for measurement or scribing. It is especially useful where rapid storage and deployment, measurement scale verification and ease of use is required.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A scribing tool comprising:

a planar body having a first end and a second end a first edge extending between said first end and said second end and a second edge oppositely disposed with respect to said first edge, a first slot having a first side at a right angle with respect to said first edge, a middle extent, and a second side, said second side of said slot terminating at a first acute angle termination having a first pre-set spacing apart from said first side of said first slot for scribing a first line on a length of material having a material edge, said first line having said first pre-set spacing apart from said material edge, and wherein said planar body has a second slot having a first side at a right angle with respect to said first edge, a middle extent, and a second side, said second side of said second slot terminating at a second acute angle termination having a second pre-set spacing apart from said first side of said second slot, and of a different magnitude than said first pre-set spacing, for scribing a second line on a length of material having a material edge, said second line having said second pre-set spacing apart from said material edge.

2. The system as recited in claim 1 and wherein said planar body has a third slot having a first side at a right angle with respect to said second edge, a middle extent, and a second side, said second side of said third slot terminating at a third acute angle termination having a third pre-set spacing apart from said first side of said third slot, and of a different magnitude than said second pre-set spacing and of a different magnitude than said first pre-set spacing, for scribing a third line on a length of material having a material edge, said third line having said third pre-set spacing apart from said material edge.

3. The system as recited in claim 2 and wherein said planar body has a first outwardly curved edge extending between said third acute angle termination and one of said first and said second acute angle terminations.

4. The system as recited in claim 3 and wherein said planar body has a fourth slot having a first side at a right angle with respect to said second edge, a middle extent, and a second side, said second side of said fourth slot terminating at a fourth acute angle termination having a fourth pre-set spacing apart from said first side of said fourth slot, and of a different magnitude than said third pre-set spacing and of a different magnitude than said second pre-set spacing and of a different magnitude than said first pre-set spacing, for scribing a fourth line on a length of material having a material edge, said fourth line having said fourth pre-set spacing apart from said material edge.

5. The system as recited in claim 4 and wherein said planar body has a first outwardly curved edge extending between said third acute angle termination and one of said first and said second acute angle terminations, and wherein said planar body has a second outwardly curved edge extending between said fourth acute angle termination and the other one of said first and said second acute angle terminations.

6. A scribing tool comprising:

a planar body having a first end and a second end, a first edge extending between said first end and said second end and a second edge oppositely disposed with respect to said first edge, a first slot having a first side at a right angle with respect to said first edge, a middle extent, and a second side, said second side of said slot terminating at a first acute angle termination having a first pre-set spacing apart from said first side of said first slot for scribing a first line on a length of material having a material edge, said first line having said first pre-set spacing apart from said material edge, and wherein said planar body has a second slot having a first side at a right angle with respect to said second edge, a middle extent, and a second side, said second side of said second slot terminating at a second acute angle termination having a second pre-set spacing apart from said first side of said second slot, and of a different magnitude than said first pre-set spacing, for scribing a second line on a length of material having a material edge, said second line having said second pre-set spacing apart from said material edge.

7. The system as recited in claim 6 and wherein said planar body has a first outwardly curved edge extending between said first and said second acute angle terminations.

8. The system as recited in claim 1 and wherein said planar body has a scale lying along at least one of said first and second edges.

9. The system as recited in claim 6 and wherein said planar body has a scale lying along at least one of said first and second edges.

* * * * *